US012565366B2

(12) United States Patent
Croft et al.

(10) Patent No.: US 12,565,366 B2
(45) Date of Patent: Mar. 3, 2026

(54) TAMPER-EVIDENT CONTAINER WITH ADDITIONAL LOCK

(71) Applicant: D&W Fine Pack, Wood Dale, IL (US)

(72) Inventors: Brandon Hutch Croft, Fort Wayne, IN (US); Thomas Lee Lape, Leo, IN (US)

(73) Assignee: D&W Fine Pack, Wood Dale, IL (US)

( * ) Notice: Subject to any disclaimer, the term of this patent is extended or adjusted under 35 U.S.C. 154(b) by 0 days.

(21) Appl. No.: 18/800,240

(22) Filed: Aug. 12, 2024

(65) Prior Publication Data

US 2025/0051072 A1 Feb. 13, 2025

Related U.S. Application Data

(60) Provisional application No. 63/518,593, filed on Aug. 10, 2023.

(51) Int. Cl.

| | |
|---|---|
| ***B65D 55/06*** | (2006.01) |
| ***B65D 43/16*** | (2006.01) |
| ***B65D 43/22*** | (2006.01) |

(52) U.S. Cl.

CPC ..... *B65D 55/06* (2013.01); *B65D 43/162* (2013.01); *B65D 43/22* (2013.01); *B65D 2401/10* (2020.05); *B65D 2543/00101* (2013.01)

(58) Field of Classification Search

CPC ..... B65D 55/06; B65D 43/162; B65D 43/22; B65D 2401/10; B65D 2543/00101

See application file for complete search history.

(56) References Cited

U.S. PATENT DOCUMENTS

| | | | | |
|---|---|---|---|---|
| 8,186,531 | B2 | 5/2012 | Parikh et al. | |
| 8,215,485 | B2 | 7/2012 | Maroofian et al. | |
| 8,640,914 | B2 | 2/2014 | Meyer et al. | |
| 8,672,166 | B2 | 3/2014 | Nazareth et al. | |
| 9,592,937 | B1 * | 3/2017 | Wang | B65D 1/34 |
| 9,676,527 | B2 | 6/2017 | McCumber | |
| 9,932,153 | B2 | 4/2018 | Hsieh | |
| 9,950,845 | B2 | 4/2018 | Hsieh | |
| 10,266,312 | B2 | 4/2019 | Fosse | |
| 10,322,858 | B2 | 6/2019 | Hsieh | |
| 10,343,824 | B2 | 7/2019 | Fosse | |
| 10,494,161 | B2 | 12/2019 | Fosse | |
| 10,532,860 | B2 | 1/2020 | Hsieh | |
| 10,611,528 | B2 | 4/2020 | Hansen et al. | |
| 11,505,373 | B2 * | 11/2022 | Jackson | B65D 43/164 |
| 2007/0202221 | A1 * | 8/2007 | Hinze | B65D 43/021 206/467 |

(Continued)

*Primary Examiner* — James N Smalley

(74) *Attorney, Agent, or Firm* — Dority & Manning, P.A.

(57) ABSTRACT

A container includes a base and a lid configured to selectively move between an open position and a closed position. A storage volume of the container is defined by and between the base and the lid in the closed position. The container also includes a first tab on the base, a second tab on the lid, a first locking member, and a second locking member. The second locking member is configured to interlock with the first locking member such that the base and the lid are retained in the closed position when the first locking member and the second locking member are interlocked. The container also includes a bump projecting from one of the first tab and the second tab, such that at least a portion of the second tab is deflected when the lid and the base are in the closed position.

20 Claims, 9 Drawing Sheets

(56) References Cited

U.S. PATENT DOCUMENTS

| | | | | |
|---|---|---|---|---|
| 2010/0224630 | A1* | 9/2010 | Petlak | B65D 43/0254 220/270 |
| 2012/0103990 | A1 | 5/2012 | McCumber | |
| 2015/0028033 | A1* | 1/2015 | Samuel | B65D 43/162 220/270 |
| 2017/0283139 | A1* | 10/2017 | Fosse | B65D 75/22 |

* cited by examiner

TAMPER-EVIDENT CONTAINER WITH ADDITIONAL LOCK

CROSS-REFERENCE TO RELATED APPLICATIONS

This application claims benefit of the filing date of U.S. Provisional Patent Application Ser. No. 63/518,593, having a filing date of Aug. 10, 2023, which is incorporated herein by reference for all purposes.

FIELD OF THE INVENTION

The present subject matter relates generally to storage containers, and more particularly to storage containers having tamper evident features.

BACKGROUND OF THE INVENTION

Plastic containers may be used for packaging and storing various items. Such containers may be used in a retail setting, for example in order to display a quantity of goods stored therein for sale as a unit. The items stored in such containers may be food items, such as perishable food items, or may be other items which are subject to tampering, spoilage, and/or theft of one or more of the items from the container.

Such storage containers may be provided with tamper-evident features to provide an indication of whether the container was previously opened, such as prior to a sale to a consumer. For example, such features may be desired to indicate the container has been opened or otherwise tampered with, such as may be indicative of potential theft, contamination, spoilage, or other concerns.

Existing tamper-evident features may have limitations, such as may be easily circumventable or the difference between the container in an unopened state and a post-opening state may be slight or subtle, such that the previous opening of the container is not readily identifiable at a quick glance.

Accordingly, storage containers with features for improved, e.g. more reliable or easily discerned, indication of prior opening, would be useful.

BRIEF DESCRIPTION OF THE INVENTION

Aspects and advantages of the invention will be set forth in part in the following description, or may be apparent from the description, or may be learned through practice of the invention.

In an exemplary embodiment, a container is provided. The container defines a vertical direction, a lateral direction, and a transverse direction. The vertical, lateral, and transverse directions are mutually perpendicular. The container includes a base and a lid. The base extends along the vertical direction between a floor approximately at a bottom of the base and an opening approximately at a top of the base. The lid and the base are configured to selectively move between an open position and a closed position. A storage volume of the container is defined by and between the base and the lid in the closed position. The container also includes a first tab on the base. The first tab extends from the base approximately perpendicular to the vertical direction. The first tab includes a first locking member. The container further includes a bump projecting upward along the vertical direction from the first tab. The container also includes a second tab on the lid. The second tab includes a second locking member configured to interlock with the first locking member such that the base and the lid are retained in the closed position when the first locking member and the second locking member are interlocked. The bump deflects at least a portion of the second tab upward along the vertical direction when the lid and the base are in the closed position.

In another exemplary embodiment, a container is provided. The container includes a base and a lid. The base and the lid are configured to selectively move between an open position and a closed position. A storage volume of the container is defined by and between the base and the lid in the closed position. The container also includes a first tab on the base with a first locking member positioned on the first tab, and a second tab on the lid with a second locking member positioned on the second tab. The second locking member is configured to interlock with the first locking member such that the base and the lid are retained in the closed position when the first locking member and the second locking member are interlocked. The container also includes a bump projecting from one of the first tab and the second tab such that at least a portion of the second tab is deflected when the lid and the base are in the closed position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
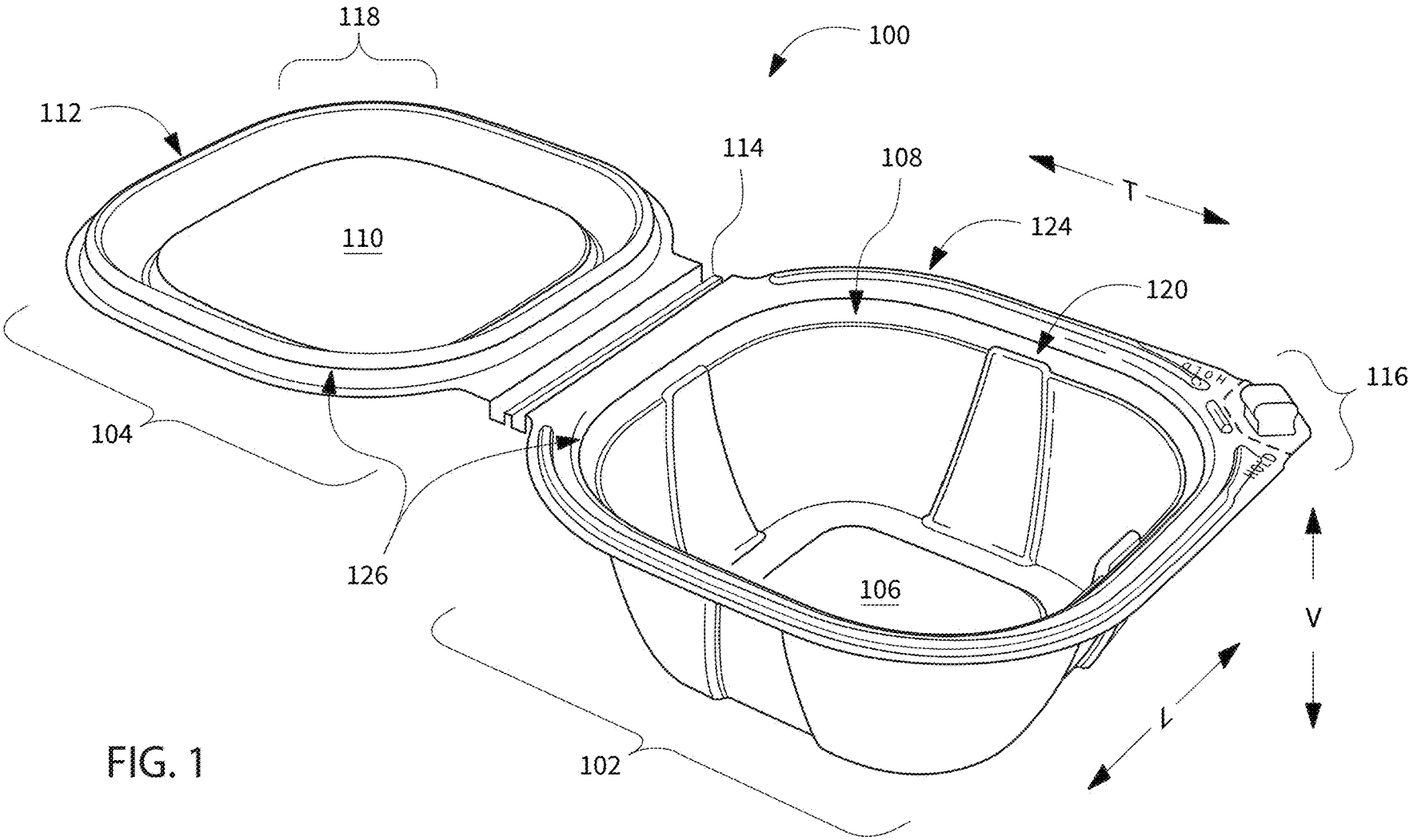
FIG. 1 provides a perspective view of a container in an initial open position according to one or more exemplary embodiments of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment.

Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Referring now to the figures, an exemplary container will be described in accordance with exemplary aspects of the present subject matter. FIGS. 1, 4, 8, and 9 provide perspective views of an exemplary container 100. As illustrated, container 100 generally defines a vertical direction V, a lateral direction L, and a transverse direction T, each of which is mutually perpendicular, such that an orthogonal coordinate system is generally defined.

Figure 4:
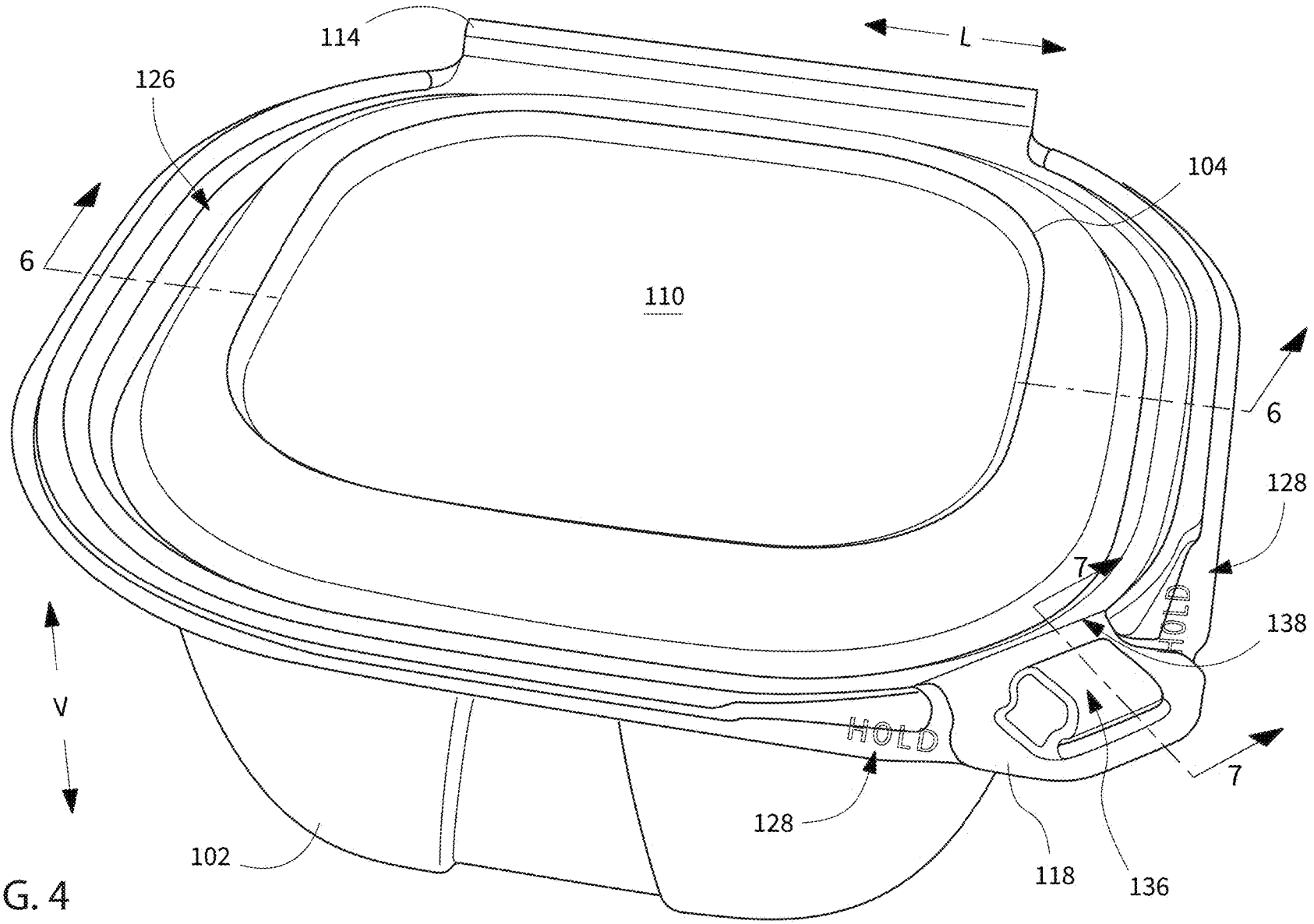
FIG. 4 provides a perspective view of the container in an initial closed position.
Figure 5:
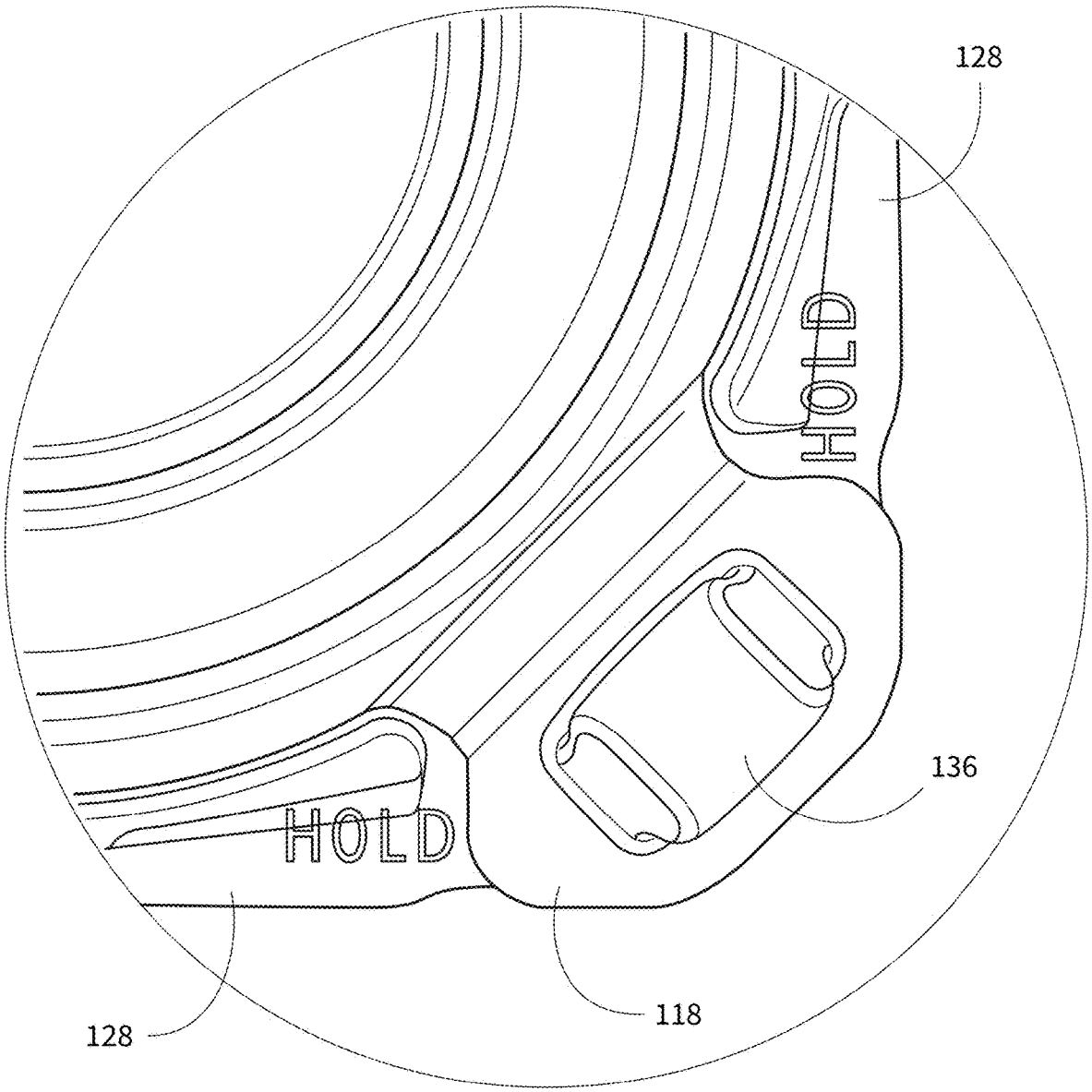
FIG. 5 provides an enlarged view of a portion of the container of FIG. 4.
Figure 8:
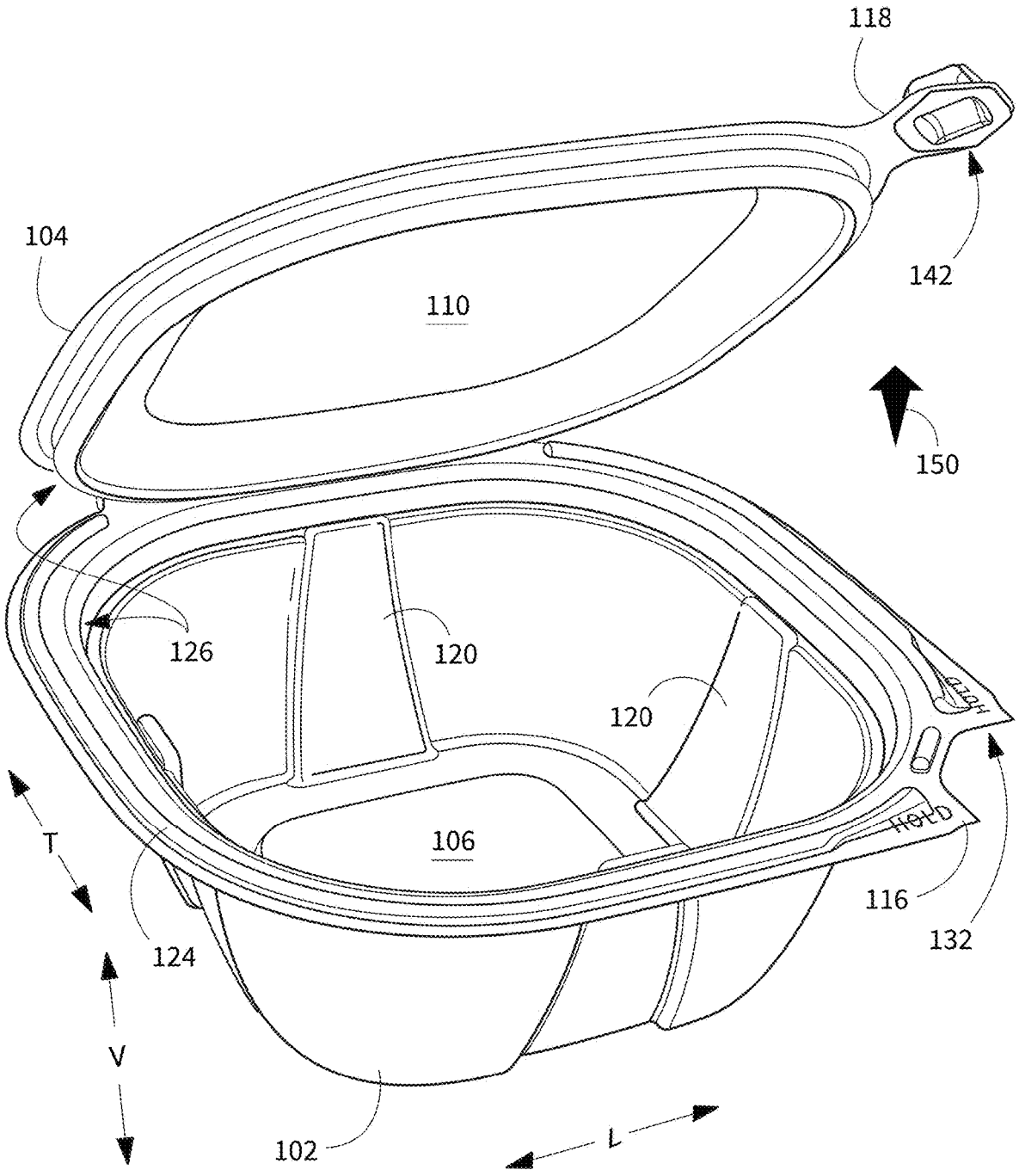
FIG. 8 provides a perspective view of the container in a subsequent open position.
Figure 9:
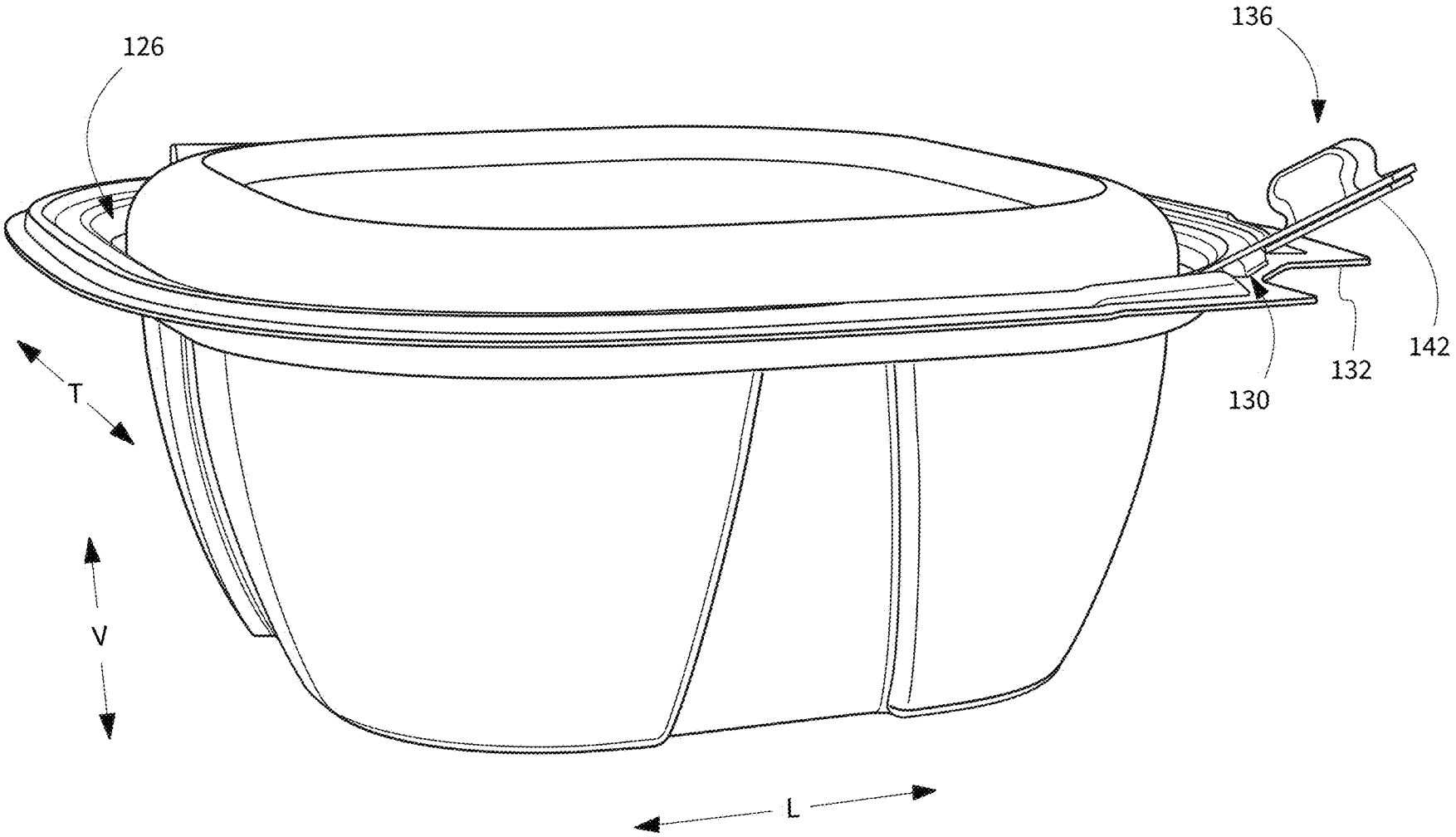
FIG. 9 provides a perspective view of the container in a subsequent closed position.

The container 100 may be repeatedly opened and closed multiple times, and may include features to indicate that the container 100 has been opened (such as opened after items such as food items have been placed therein) and then reclosed. Specifically, FIG. 1 illustrates the container 100 in an initial open position, such as an as-manufactured condition. Thus, items to be stored, such as food items, may be loaded into the container 100 while the container 100 is in the initial open position as illustrated in FIG. 1. From the initial open position of FIG. 1, the container 100 may move to an initial closed position, e.g., as illustrated in FIG. 4. For example, the container 100 may be moved to the initial closed position by coupling the lid 104 onto the base 102, such as after loading the container 100 with the items to be stored. In the initial closed position, the container 100 may be sealed and locked shut. For example, the container 100 may be locked shut by mutual engagement of locking elements, such as a first locking element 134 and a second locking element 136. Once closed for the first time, e.g., after moving from the initial open position of FIG. 1 to the initial closed position of FIG. 4, the container 100 may not be opened again without altering the structure of the container 100, and such alteration may be visually apparent, e.g., in order to indicate that the container 100 may have been tampered with and/or items stored therein may have been accessed. In particular, FIG. 8 illustrates the container 100 in a subsequent open position, e.g., an open position to which the base 102 and the lid 104 may be moved after the initial closed position. As may be seen in FIG. 8 and as will be described in further detail below, the container 100 may include a frangible portion 142, and the opening of the container 100 may be evidenced by the frangible portion 142 detached from an initial position of the frangible portion 142. FIG. 9 illustrates the container 100 in a subsequent closed position, e.g., a position in which the container 100 has been reclosed after having been previously closed and then opened. In the subsequent closed position, a portion of the container 100 may be deflected in order to provide a readily ascertainable visual indication that the container 100 has been previously opened (the previous opening other than and after the initial open position) and may also indicate that the container 100 is no longer locked in the closed position. For example, a second tab 118 on the lid 104, as well as the frangible portion 142 which may be locked to the second tab 118, may be deflected in the reclosed or subsequent closed position, to thereby indicate the container 100 and/or contents thereof may have been tampered with.

Referring again to FIG. 1, the container 100 may include a base 102 and a lid 104. In some embodiments, the base 102 and the lid 104 may be separately formed, such that the lid 104 may be entirely removable from the base 102. In other embodiments, e.g., as illustrated in FIG. 1, the base 102 and the lid 104 may be integrally joined, such as integrally joined by a living hinge 114. The lid 104 and the base 102 may be configured to selectively move between an open position in which the interior of the container 100 is accessible and a closed position in which the lid 104 is releasably coupled to the base 102. For example, in the illustrated embodiments, the lid 104 and the base 102 may move between an open position (e.g., initial or subsequent open position) and a closed position (e.g., initial or subsequent closed position) by rotating about the living hinge 114. In additional embodiments, the lid 104 and the base 102 may move between an open position and a closed position by entirely decoupling the lid 104 and the base 102, e.g., in embodiments where the base 102 and the lid 104 are separately formed.

The base 102 may extend along the vertical direction V from a floor 106, e.g., approximately at the bottom of the base 102, to an opening 108. The opening 108 may be defined at or approximately at the top of the base 102. The lid 104 may include an opening 112, and the opening 112 may be positioned approximately at the bottom of the lid 104 when the lid and the base 102 are in the closed position. The lid 104 may extend along the vertical direction V from the opening 112 to a ceiling 110. When in the closed position, the ceiling 110 may be above the opening 112, and the ceiling 110 may be positioned approximately at a top of the lid 104 and a top of the overall container 100 as a whole. As noted above, the term "approximately" is used herein to include plus or minus ten percent, such as "approximately at" a top or bottom includes offsets from the topmost or bottommost edge or surface by up to ten percent of a total vertical dimension (e.g., height) of the overall container 100 when the container 100 is in a closed position.

Figure 6:
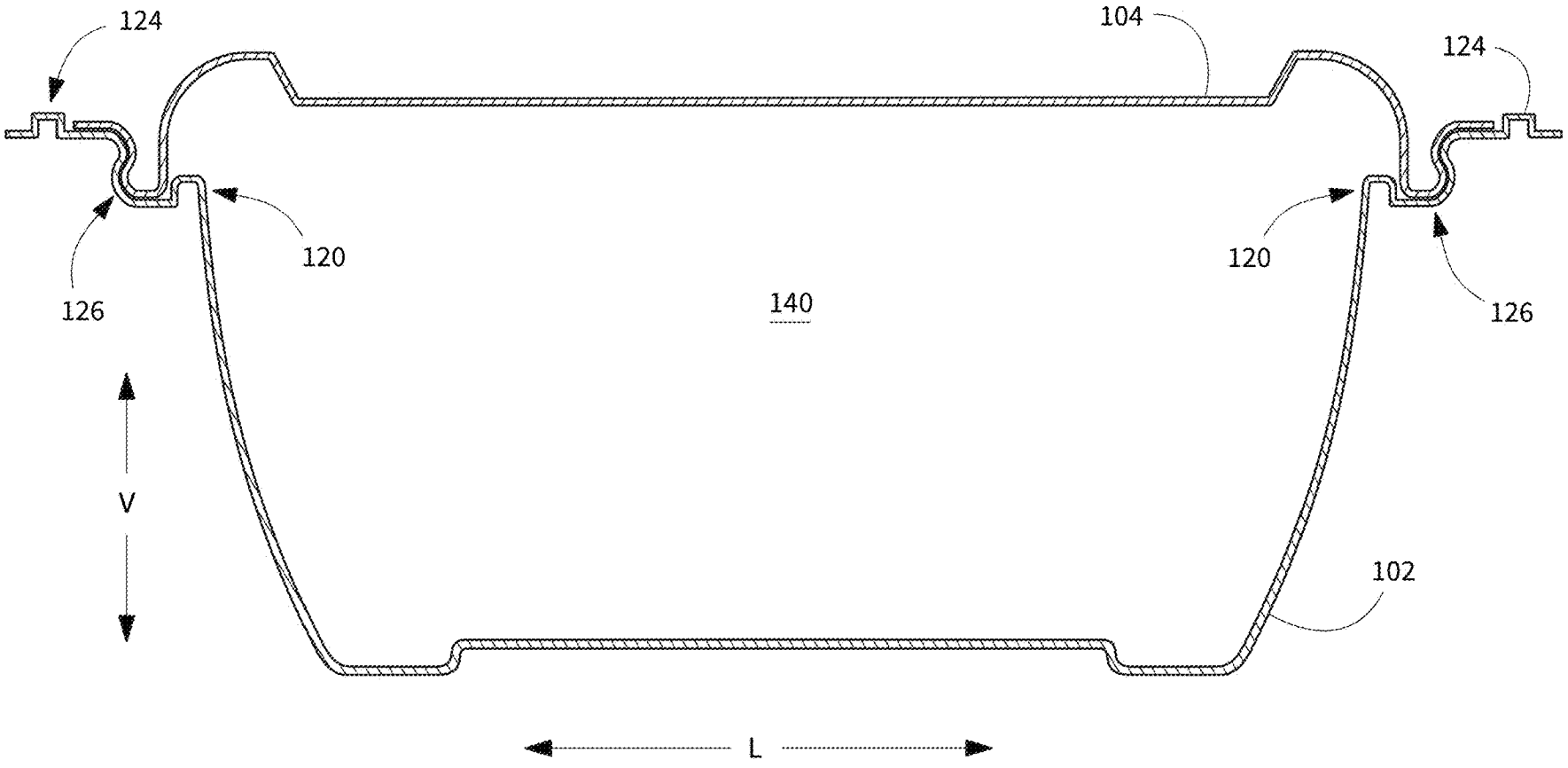
FIG. 6 provides a section view of the container of FIG. 4.

The lid 104 and the base 102 may be releasably coupled at the opening 108 of the base 102 and the opening 112 of the lid 104 when the lid 104 and the base 102 are in the closed position. For example, the openings 108 and 112 may be superimposed on each other and/or may overlap when the base 102 and the lid 104 are in the closed position. In some embodiments, a perimeter seal 126 may be provided around each opening 108, 112. For example, the perimeter seal 126 may include a convex curved portion on one of the base 102 and the lid 104 and a corresponding concave curved portion on the other of the base 102 and the lid 104, and the respective curved portions may be located proximate to and around each opening 108, 112, such that, when the base 102 and the lid 104 are in a closed position, a storage volume 140 (see, e.g., FIG. 6) of the container 100 is defined by and between the base 102 and the lid 104. The storage volume 140 may thus be fully enclosed and sealed between the base 102 and the lid 104, such as sealed by the perimeter seal 126, when the container 100 is in a closed position.

The container 100 may further include a flange around the perimeter of the base 102 with a ridge 124 which extends from the flange, e.g., upward along the vertical direction V. In additional embodiments, the ridge 124 may be positioned on the lid 104 and may, for example, extend downward along the vertical direction V when the lid 104 is coupled to the base 102 in the closed position. The ridge 124 may be positioned outward of the perimeter seal 126, e.g., where outward refers to farther from the geometric center of the container 100. Thus, as may be seen, e.g., in FIG. 6, the ridge 124 may prevent or limit access to the perimeter seal 126, such as to prevent opening of the container 100 or other breaching of the perimeter seal 126. The container 100 may also include one or more inner posts 120, such as four inner posts 120, formed in one or more sidewalls of the base 102. As may be seen, e.g., in FIG. 6, the inner posts 120 may help to hold the lid 104 in place in the closed position, e.g., in the initial or subsequent closed position, by preventing shifting of the lid 104 along the lateral direction L and/or transverse direction T from the closed position.

In the illustrated exemplary embodiments, the base 102 is relatively deep and the lid 104 is relatively shallow, e.g., a distance from the floor 106 to the opening 108 is much greater than, such as several times greater than, the distance from the ceiling 110 to the opening 112 of the lid 104. Accordingly, the internal storage volume 140 is predominantly provided in the base 102 in the exemplary container 100 embodiments illustrated in the accompanying FIGS. In other embodiments, however, the proportions of the base 102 and the lid 104 may vary, such as may be approximately equal, or the base 102 may be relatively shallow while the lid 104 is relatively deep.

The container 100 may also include a first tab 116. The first tab 116 may be positioned on the base 102 such as the first tab 116 may extend from the base 102 approximately perpendicular to the vertical direction V, e.g., as illustrated in FIG. 1. The container 100 may also include a first locking member 134 (see, e.g., FIG. 2), such as the first tab 116 may include the first locking member 134 and/or the first locking member 134 may be positioned on the first tab 116. As may be seen in FIG. 3 in particular, the container 100 may include a second tab 118 and a second locking member 136. FIG. 3 is a view of the second tab 118 in the initial open position, looking at the second tab 118 from the ceiling 110 side of the lid 104. In some embodiments, the first tab 116 may be positioned at a corner of the base 102 and the second tab 118 may be positioned at a corner of the lid 104. The first locking member 134 and the second locking member 136 may be configured to interlock with each other, such that the base 102 and the lid 104 are retained in the closed position when the first locking member 134 and the second locking member 136 are interlocked. The first locking member 134 may be a male locking member and the second locking member 136 may be a female locking member, e.g., as illustrated, such that the first locking member 134 and the second locking member 136 have corresponding shapes and are sized such that the first locking member 134 may be received within the second locking member 136, such as with a snap fit or interference fit. In additional embodiments, the arrangement of the first locking member 134 and the second locking member 136 may be reversed. In some embodiments, e.g., as illustrated, the first and second locking members 134 and 136 may comprise a bar lock having a generally trapezoidal shape (see, e.g., FIG. 7). In additional embodiments, the lock may have any suitable shape including a first projecting member received (e.g., snap fit) within a second recessed member, such as the locking members may have a rounded, e.g., circular or oval, cross-sectional shape, or any other shape may be provided in accordance with various embodiments of the present disclosure.

Figure 7:
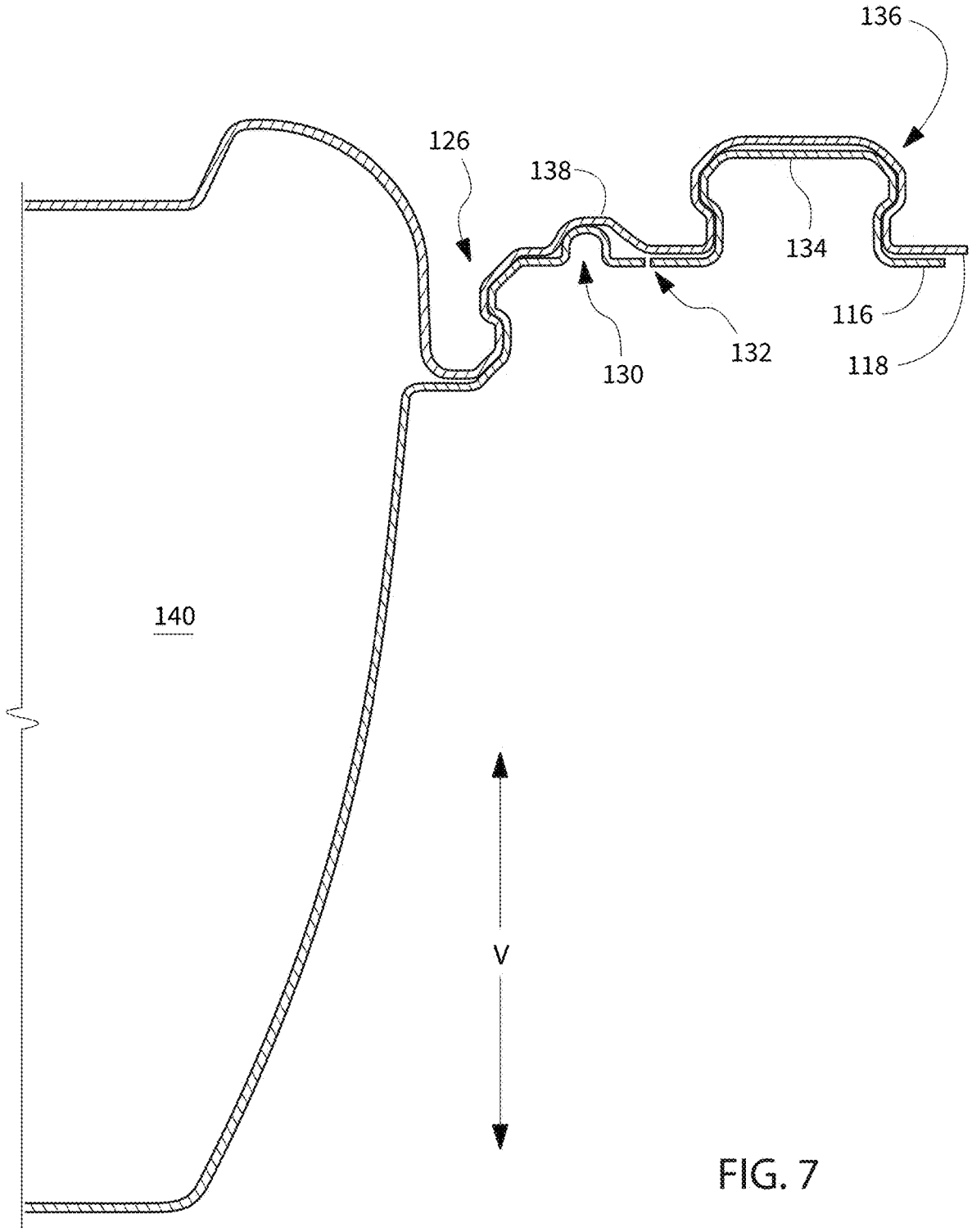
FIG. 7 provides a section view of a portion of the container of FIG. 4.

The container 100 may further include a bump 130. For example, as may be seen in FIG. 2, the bump 130 may be provided on the first tab 116 and may extend upward along the vertical direction V. The bump 130 may be positioned and configured such that, when the base 102 and the lid 104 are in the closed position, the bump 130 deflects at least a portion of the second tab 118 upward along the vertical direction V. For example, as illustrated in FIGS. 4 and 7, when the container 100 is in the initial closed position, such as a sealed and locked closed position, the bump 130 deflects a portion 138 of the second tab 118. As another example, e.g., as illustrated in FIG. 9, when the container 100 is in the subsequent closed position, such as when the container 100 has been previously closed and sealed and then opened, the bump 130 may deflect all or most of the second tab 118 upward along the vertical direction V such that the second tab 118 may extend outward along a horizontal direction (e.g., the lateral direction L and/or transverse direction T) and upward along the vertical direction V.

Figure 2:
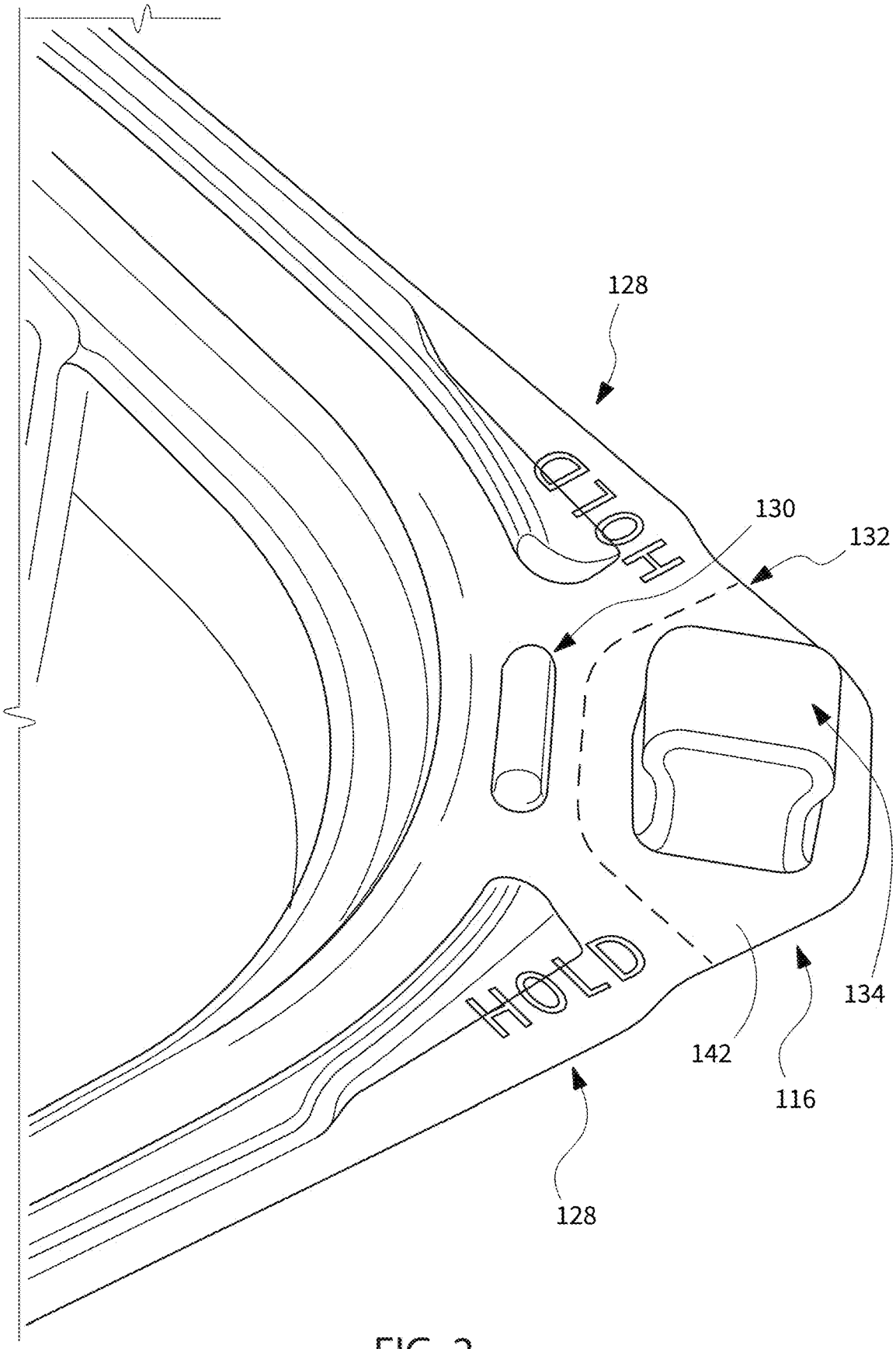
FIG. 2 provides an enlarged view of a portion of the container of FIG. 1.
Figure 3:
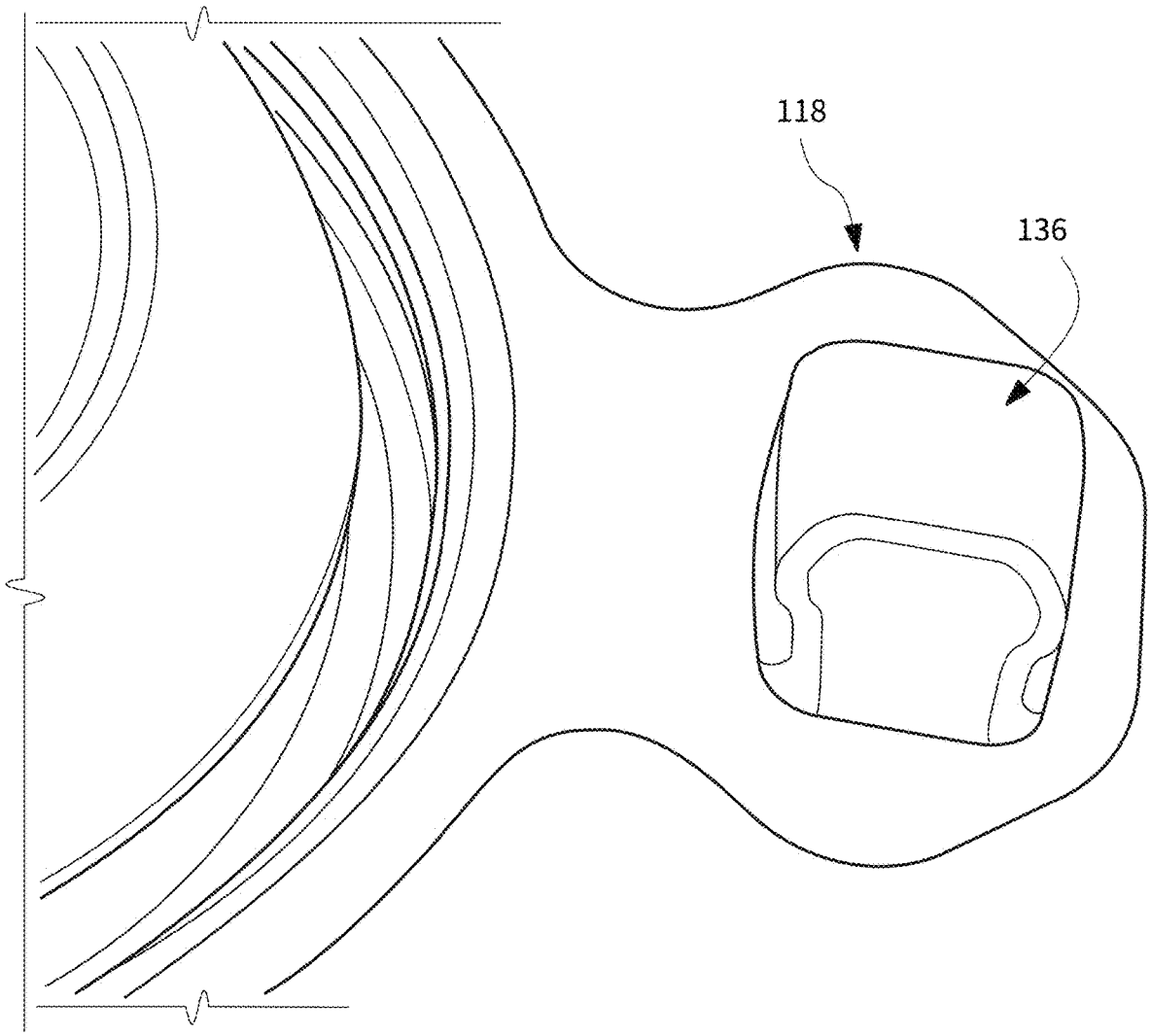
FIG. 3 provides another enlarged view of another portion of the container of FIG. 1.

Referring now to FIG. 2 in particular, the first tab 116 may include one or more holding portions 128, which a user or consumer may grip in order to open the container 100, e.g., from the initial closed position. Also as may be seen in FIG. 2, the container 100 may include a line of reduced strength 132 which extends across the first tab 116. The line of reduced strength 132 has reduced strength, e.g., as compared to remainder of the first tab 116. The line of reduced strength 132 may be include a line that is perforated or otherwise partially cut, reduced in thickness, and/or otherwise reduced material strength through the first tab 116. For example, the illustrated line of reduced strength 132 is formed by a linear series of perforations through the thickness (e.g., vertical dimension) of the first tab 116. Accordingly, a frangible portion 142 of the first tab 116 may be defined. For example, the line of reduced strength 132 may extend fully across the first tab 116, such as the line of reduced strength 132 may begin at one external edge of the first tab 116 and extend to another external edge of the first tab 116. Accordingly, the frangible portion 142 may be defined by and between the line of reduced strength 132 and the external edges of the first tab 116. In various embodiments, the frangible portion 142 may be defined by one or more line(s) of reduced strength 132, e.g., the frangible portion 142 may be bounded by the one or more line(s) of reduced strength along at least one edge of the frangible portion 142. The frangible portion 142 may also be defined on one or more edges thereof by an external edge of the first tab 116, or the entire periphery of the frangible portion 142 may be internal to the first tab 116 and defined by one or more lines of reduced strength. In additional embodiments, the frangible portion 142 may be formed on the second tab 118 instead of the first tab 116.

As seen throughout the FIGS., when the container 100 is in the initial open position or the initial closed position, the frangible portion 142 remains directly connected to the first tab 116, e.g., across the line of reduced strength 132, such as at the connected portions between each perforation in the illustrated exemplary embodiments. Once the container 100 has been re-opened, e.g., opened after the initial closed position, the frangible portion 142 may still be connected to the first tab 116 but only indirectly connected, such as connected via the second tab 118, lid 104, hinge 114, and base 102, as illustrated for example in FIGS. 8 and 9. That is, the frangible portion 142 may be directly connected to the first tab 116 when the frangible portion 142 is unbroken and the line of reduced strength 132 is intact, whereas, when the container 100 is subsequently opened after being locked shut, the frangible portion 142 may detach from the first tab 116 by breaking the first tab 116 along the line of reduced strength 132.

In some embodiments, the first locking member 134 may be positioned on the frangible portion 142. For example, the first locking member 134 may be positioned on the first tab 116 outward of the line of reduced strength 132, e.g., as illustrated in FIG. 2. In some embodiments, e.g., as may be seen in FIGS. 5 and 7-9, the second tab 118 may extend outward of the first tab 116 when the lid 104 and the base 102 are in the closed position, and such outward extension may impede access to the first locking member 134 when the container 100 is locked closed, e.g., to reduce or avoid circumvention of the lock. Accordingly, the container 100 may be opened after the initial closed position by grasping and holding one of the holding portions 128 with one hand while also grasping the second tab 118, the frangible portion 142 of the first tab 116, and/or one or both locking members 134 and 136 with the other hand. Then, the lid 104 may be opened by pulling up with the other hand such that the lid 104 moves away from the base 102, e.g., as indicated by arrow 150 in FIG. 8. The frangible portion 142 may then separate from the first tab 116, e.g., along the line of reduced strength 132, and the first locking member 134 on the frangible portion 142 may remain interlocked with the second locking member 136 on the second tab 118, e.g., as may be seen in FIGS. 8 and 9.

Where the frangible portion 142 remains attached to other parts of the container 100, e.g., the second tab 118, the previous opening of the container 100 may be evidenced by the presence of the frangible portion 142, such as in contrast to other tamper indicating features which are fully separate from a package when detached, such that an observer may not know such package was previously opened if the observer is not aware that such other tamper indicating feature should be present. As such, the container 100 of the present disclosure may provide a more reliable tamper indication.

As may be seen in FIG. 9, when the container 100 is reclosed, e.g., is in a subsequent closed position after the subsequent open position, such that the container 100 is no longer locked shut (but may still be sealed, e.g., by reengagement of the perimeter seal 126), such as the first and second locking members 134 and 136 are no longer locking the lid 104 and base 102 together due to the breaking of the line of reduced strength 132 and separation of the frangible portion 142 from the first tab 116, the bump 130 may deflect the entire second tab 118 upward, as described above. Such deflection of the second tab 118 may provide a clear and readily observable indication that the container 100 is unlocked. For example, the deflection of the second tab 118 in the subsequent closed position (FIG. 9) as compared to the orientation of the second tab 118 in the initial closed position (see, e.g., FIG. 4) may provide a clear distinction between the initial closed position and the second closed position, which may thus provide a consistent and easily detected indication of potential tampering or theft. As may be seen, for example by comparing FIGS. 4 and 9, the bump 130 may deflect only a portion of the second tab 118 when the lid 104 and the base 102 are in the closed position and the line of reduced strength 132 is intact and the frangible portion 142 is directly joined to the first tab 116 (FIG. 4), and the bump 130 may deflect all or most of the second tab 118 upward, such as the second locking member 136 on the second tab 118 and the first locking member 134 (which may remain interlocked with the second locking member 136), when the lid and the base 102 are in the closed position and the line of reduced strength 132 and the frangible portion 142 are broken (FIG. 9).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A container defining a vertical direction, a lateral direction, and a transverse direction, the vertical, lateral, and transverse directions being mutually perpendicular, the container comprising:

a base extending along the vertical direction between a floor approximately at a bottom of the base and an opening approximately at a top of the base;

a lid, the lid and the base configured to selectively move between an open position and a closed position, wherein a storage volume of the container is defined by and between the base and the lid in the closed position;

a first tab on the base, the first tab extending from the base approximately perpendicular to the vertical direction, the first tab comprising a first locking member;

a bump projecting upward approximately along the vertical direction from the first tab;

a second tab on the lid, the second tab comprising a second locking member configured to interlock with the first locking member whereby the base and the lid are retained in the closed position when the first locking member and the second locking member are interlocked, wherein the bump deflects at least a portion of the second tab upward along the vertical direction when the lid and the base are in the closed position; and a line of reduced strength defined in the first tab, wherein the first locking member is positioned outward of the line of reduced strength, wherein the bump deflects a portion of the second tab upward along the vertical direction when the lid and the base are in the closed position and the line of reduced strength is intact, and wherein the bump deflects the first locking member and the second locking member upward along the vertical direction when the lid and the base are in the closed position and the line of reduced strength is broken.

2. The container of claim 1, wherein the first tab is positioned at a corner of the base and the second tab is positioned at a corner of the lid.

3. The container of claim 1, wherein the second tab extends outward of the first tab when the lid and the base are in the closed position.

4. The container of claim 1, wherein the lid is configured to releasably couple to the base at the opening of the base when in the closed position.

5. The container of claim 1, wherein the base and the lid are integrally joined by a living hinge.

6. The container of claim 1, further comprising a perimeter seal defined around a perimeter of the container when the lid and the base are in the closed position.

7. The container of claim 6, further comprising a ridge outward of the perimeter seal, wherein the ridge obstructs access to the perimeter seal.

8. A container, comprising:

a base;

a lid, the lid and the base configured to selectively move between an open position and a closed position, wherein a storage volume of the container is defined by and between the base and the lid in the closed position;

a first tab on the base;

a first locking member positioned on the first tab;

a second tab on the lid;

a second locking member positioned on the second tab, the second locking member configured to interlock with the first locking member whereby the base and the lid are retained in the closed position when the first locking member and the second locking member are interlocked;

a bump projecting from one of the first tab and the second tab, whereby at least a portion of the second tab is deflected when the lid and the base are in the closed position; and a line of reduced strength defined in the first tab, wherein the first locking member is positioned outward of the line of reduced strength, wherein the bump deflects a portion of the second tab when the lid and the base are in the closed position and the line of reduced strength is intact, and wherein the bump deflects the first locking member and the second locking member when the lid and the base are in the closed position and the line of reduced strength is broken.

9. The container of claim 8, wherein the first tab is positioned at a corner of the base and the second tab is positioned at a corner of the lid.

10. The container of claim 8, wherein the second tab extends outward of the first tab when the lid and the base are in the closed position.

11. The container of claim 8, wherein the lid is configured to releasably couple to the base at an opening of the base when in the closed position.

12. The container of claim 8, wherein the base and the lid are integrally joined by a living hinge.

13. The container of claim 8, further comprising a perimeter seal defined around a perimeter of the container when the lid and the base are in the closed position.

14. The container of claim 13, further comprising a ridge outward of the perimeter seal, wherein the ridge obstructs access to the perimeter seal.

15. A container, comprising:

a base;

a lid, the lid and the base configured to selectively move between an open position and a closed position, wherein a storage volume of the container is defined by and between the base and the lid in the closed position;

a first tab on the base;

a first locking member positioned on the first tab;

a second tab on the lid;

a second locking member positioned on the second tab, the second locking member configured to interlock with the first locking member whereby the base and the lid are retained in the closed position when the first locking member and the second locking member are interlocked;

a bump projecting from one of the first tab and the second tab, whereby at least a portion of the second tab is deflected when the lid and the base are in the closed position; and a frangible portion of the first tab, wherein the bump deflects a portion of the second tab when the lid and the base are in the closed position and the frangible portion is directly joined to the first tab, and wherein the bump deflects the first locking member and the second locking member when the lid and the base are in the closed position and the frangible portion is broken.

16. The container of claim 15, wherein the first tab is positioned at a corner of the base and the second tab is positioned at a corner of the lid.

17. The container of claim 15, wherein the second tab extends outward of the first tab when the lid and the base are in the closed position.

18. The container of claim 15, wherein the lid is configured to releasably couple to the base at an opening of the base when in the closed position.

19. The container of claim 15, wherein the base and the lid are integrally joined by a living hinge.

20. The container of claim 15, further comprising a perimeter seal defined around a perimeter of the container when the lid and the base are in the closed position.

* * * * *